US007132380B2

(12) United States Patent
Böttger et al.

(10) Patent No.: US 7,132,380 B2
(45) **Date of Patent: *Nov. 7, 2006**

(54) PENETRATION-RESISTANT MATERIAL COMPRISING FABRIC WITH HIGH LINEAR DENSITY RATIO OF TWO SETS OF THREADS

(75) Inventors: Christian Böttger, Remscheid (DE); Achim Fels, Wuppertal (DE); Christoph Baumgart, Spockhövel (DE); Bärbel Dorloff-Lumpe, Wuppertal (DE)

(73) Assignee: Teijin Twaron GmbH, Wuppertal (DE)

( * ) Notice: Subject to any disclaimer, the term of this patent is extended or adjusted under 35 U.S.C. 154(b) by 124 days.

This patent is subject to a terminal disclaimer.

(21) Appl. No.: 10/471,089

(22) PCT Filed: Mar. 8, 2002

(86) PCT No.: PCT/EP02/02550

§ 371 (c)(1),
(2), (4) Date: Sep. 8, 2003

(87) PCT Pub. No.: WO02/075238

PCT Pub. Date: Sep. 26, 2002

(65) Prior Publication Data

US 2004/0082242 A1 Apr. 29, 2004

(30) Foreign Application Priority Data

Mar. 15, 2001 (EP) ..... 01200979

(51) Int. Cl.
*B32B 27/12* (2006.01)

(52) U.S. Cl. ..... 442/135; 2/2.5; 428/911; 442/134; 442/149; 442/239

(58) Field of Classification Search ..... 2/2.5; 428/105, 107, 911; 442/11, 113, 911, 134, 442/135, 239, 246, 261, 286, 301, 149
See application file for complete search history.

(56) References Cited

U.S. PATENT DOCUMENTS

| | | | | |
|---|---|---|---|---|
| 5,187,003 | A | 2/1993 | Chitrangad | |
| 5,802,607 | A | 9/1998 | Triplette | |
| 5,935,678 | A | 8/1999 | Park | |
| 6,562,435 | B1 | 5/2003 | Brillhart, III et al. | |
| 6,610,618 | B1 * | 8/2003 | Bottger et al. | 442/239 |
| 6,890,871 | B1 * | 5/2005 | Bottger et al. | 442/135 |

FOREIGN PATENT DOCUMENTS

| | | |
|---|---|---|
| EP | 0 310 199 A1 | 4/1989 |
| RU | 2 096 542 C1 | 11/1997 |
| SU | 1 792 517 A3 | 1/1993 |
| WO | WO 00/42246 | 7/2000 |

* cited by examiner

*Primary Examiner*—Arti Singh
(74) *Attorney, Agent, or Firm*—Oliff & Berridge, PLC

(57) ABSTRACT

A penetration-resistant material having at least a double layer of woven fabric having a first layer of fabric composed of a first set of threads having 3.5 to 20 threads/cm, a linear density of at least 210 dtex, and at least 65% of the fabric weight, and a second set of threads having 0.5 to 16 threads/cm and a linear density of at least 50 dtex and a second layer of fabric composed of a first set of threads having 0.5 to 16 threads/cm and a linear density of at least 50 dtex, and a second set of threads having 3.5 to 20 threads/cm, a linear density of at least 210 dtex, and at least 65% of the fabric weight. In each layer, the second set are transverse to the first set and the ratio of the number of threads/cm of the second set to that of the first set is >1.

19 Claims, No Drawings

PENETRATION-RESISTANT MATERIAL COMPRISING FABRIC WITH HIGH LINEAR DENSITY RATIO OF TWO SETS OF THREADS

BACKGROUND OF THE INVENTION

1. Field of the Invention

The invention pertains to penetration-resistant material comprising a double layer of fabric with high linear density ratios of two sets of threads, and to articles made of the same.

2. Description of Related Art

Penetration-resistant articles such as bulletproof vests, helmets, vehicle panels, and shields prepared from high strength fibers are known in the art. For many applications, in particular for ballistic vests, the fibers are used in a woven or knitted fabric. These fabrics may be coated or impregnated in a matrix to obtain hard ballistic materials, or may be used free from matrix to obtain soft ballistic materials.

Bulletproof woven fabrics are known, inter alia, from EP 310,199. The fabrics disclosed therein are composed of filament yarns of ultrahigh molecular weight polymer having high strength and high modulus, with the warp threads being of a different polymeric material than the weft threads.

In Russian patent RU 2,096,542 a ballistic fabric for bulletproof jackets was disclosed having warp and weft threads of poly para-phenyleneterephthalamide (PPTA) wherein the ratio of warp to weft linear density is smaller than 4.17:1. Typically, warp threads having a linear density of 143 to 588 dtex and weft threads having a linear density of 588 to 930 were disclosed, the weft threads having equal or higher linear density than the warp threads. It is particularly contended that ballistic fabrics having warp to weft linear density ratios between 1.59 and 4.17 have improved deflection properties.

In WO 00/42246 a penetration-resistant material is disclosed comprising at least a double layer of fabric composed of two layers of woven fabric which are cross-plied at an angle wherein the fabric is composed of a first set of threads comprising 3.5 to 20 threads/cm and having a linear density of at least 420 dtex, and a second set of threads comprising 0.5 to 8 threads/cm and having a linear density of at least 50 dtex, with the second set of threads being transverse to the first set of threads, and wherein the ratio of the linear density of the first set of threads to the linear density of the second set of threads is >4.2:1, more preferably >7.5:1. In a preferred embodiment the first set of threads is warp threads made of p-aramid yarn and the second set of threads is weft threads of polyester yarn, and the ratio of the number of threads/cm of the first set to that of the second set is >1:1. Although the ballistic performance of this article is excellent, the necessity of cross-plying the layers is a disadvantage in terms of ease and simplicity of the manufacture and the danger of creating weak points, that inherently to the process of cross-plying can occur.

SUMMARY OF THE INVENTION

It has now been found that penetration-resistant materials with the advantages of the prior art materials but without their disadvantages can be made. To this end a penetration-resistant material is claimed comprising at least a double layer of woven fabric, characterized in that the double layer comprises a first layer of fabric composed of a first set of threads comprising 3.5 to 20 threads/cm, having a linear density of at least 210 dtex, and comprising at least 65% of the fabric weight, and a second set of threads comprising 0.5 to 16 threads/cm and having a linear density of at least 50 dtex, with the second set of threads being transverse to the first set of threads, and the ratio of the number of threads/cm of the first set to that of the second set is >1:1, and a second layer of fabric composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the fabric weight, with the second set of threads being transverse to the first set of threads, and the ratio of the number of threads/cm of the second set to that of the first set is >1:1, and wherein the first and second sets of threads of the first layer have a parallel orientation towards the first and second sets, respectively, of threads of the second layer.

DETAILED DESCRIPTION OF PREFERRED EMBODIMENTS

Preferably, the penetration-resistant material has at least a ratio of the linear density of the first set of threads to the linear density of the second set of threads of the first layer and of the linear density of the second set of threads to the linear density of the first set of threads of the second layer that is >1:1, more preferably >4.2:1, and most preferably >5.7:1. A particularly effective ratio is 6:1–6.6:1. The number of threads in the first set of threads of the first layer and the second set of threads of the second layer is 3.5 to 20 threads/cm. More preferably, the number is 4 to 15 threads/cm, and most preferably 5 to 12 threads/cm. The number of threads in the second set of threads of the first layer and the first set of threads of the second layer is 0.5 to 16 threads/cm. Preferably, the number is 0.5 to 8, more preferably 1 to 6 threads/cm, and most preferably 2 to 4 threads/cm. In each layer the threads having a linear density of at least 210 dtex comprise at least 65% of the fabric weight of that layer. Preferably, these threads comprise at least 70%, and more preferably 75% of the fabric weight of that layer. For reasons of efficient manufacturing it is preferred that the first set of threads of the first layer and the first set of threads of the second layer are of warp threads and the second set of threads of the first layer and the second set of threads of the second layer are wefi threads. The second set of threads is transverse to the first set of threads in each of the two layers. Although usually these sets are about perpendicular to each other, this is not necessary. The second set of threads may be provided at an angle other than 90° to the first set of threads. The two layers are secured together without cross-plying.

The penetration-resistant material also consists of a second set of threads of the first layer (preferably weft threads) and a first set of threads of the second layer (preferably warp threads), the yarn composition of which is not decisive for the present invention. Preferably, however, these threads have high strength and high modulus. This is particularly the case when these threads are selected from polyester, polyethylene, polypropylene, polyamide, and aramid yarn. Most preferably, the second set of threads of the first layer and the first set of threads of the second layer is made of polyester yarn.

The first set of threads of the first layer (preferably warp threads) and the second set of threads of the second layer (preferably weft threads) are of high strength and high modulus, and most preferably high tenacity threads from aramid, polyethylene, and poly-p-phenylenebenzobisoxazole (PBO) yarn are selected, more particularly p-aramid. Most preferred is poly para-phenyleneterephthalamide (PPTA). In a preferred embodiment the warp and weft threads are selected to be made of different polymers, for instance, a fabric having warp threads of p-aramid yarn and weft threads of polyester yarn, or reversed, is preferred.

As long as the required linear density ratio is satisfied, the linear density of the first set of threads of the first layer and the second set of threads of the second layer is selected to be at least about 210 dtex, preferably between 210 and 6720, more preferably between 420 and 3360 dtex, even more preferably between 420 and 1680 dtex, and most preferably between about 840 and 1100 dtex. The linear density of the second set of threads of the first layer and the first set of threads of the second layer is selected to be at least about 50 dtex, more preferably between 50 and 280 dtex, and most preferably between about 80 and 140 dtex.

The term "thread" means any sort of thread such as staple yarn, twisted staple yarn, twisted filament yarn, non-twisted intermingled yarn, and preferably, untwisted filament yarn.

In a preferred embodiment the threads of each of the two fabric layers of the double layer are bonded together, for instance, by stitch bonding, or preferably, with an adhesive material. The adhesive material may be adhesive material provided onto the threads or onto the fabric, for instance, as a finish. The adhesive material can also be an adhesive layer provided between the two fabric layers of the double layer. Adhesive materials include thermoplastic, elastomeric, and thermoset materials. It is also possible to use for at least part of the second set of threads of the first layer and the first set of threads of the second layer a material that melts under pressure and/or heating, thereby accomplishing binding the threads of the first set, respectively second set of threads to those of the second set, respectively first set of threads, and optionally also binding the two fabric layers together. Thermoplastic materials include polyolefins such as polyethylene and polypropylene, polyamide, polyester, or mixtures of these materials. Elastomeric materials include Kraton, rubber, silicon, and the like. Thermoset materials include epoxy resins, polyester resins, phenolic resins, vinyl ester resins, and the like.

In another preferred embodiment at least one of the outer sides of the penetration-resistant material is provided with a protective layer. The protective layer can be a thermoplastic, thermoset, or an elastomeric material, or a mixture of these materials. The protective layer is applied to protect the fabric from damage by excessive abrasion and to improve the ballistic performance.

The penetration-resistant material comprises at least one double layer consisting of two layers of woven fabric, which are non-cross-plied and optionally bonded together. The term woven includes all types of weaves, such as plain weave, satin weave, basket weave, twill-weave, and the like. Preferred fabrics are plain woven.

The penetration-resistant article may contain as little as one double layer consisting of two layers of woven fabric, but usually more double layers are applied. Suitable numbers of double layers are 5 to 100, and most preferably 6 to 35 double layers are used. The first set of threads of the first fabric layer of a double layer may be parallel to, or at an angle to, the first set of threads of the first fabric layer of the adjacent double layer. If these sets are secured together under an angle, such an angle is preferably 90°.

The double layers are secured together using an adhesive layer or by stitching. Such an adhesive layer may be made of the previously mentioned materials for the adhesive materials and has a thickness between 4 and 36μ, preferably between 8 and 20μ.

Methods of manufacture of the double layers are well known in the art. Usually the fabric is made by warping the warp yarn on a beam, followed by weaving on a loom. The single layer may optionally by impregnated or laminated, and be subjected to a calandering or lamination process. At least two fabric layers can be bonded together by stitching, heating, or applying pressure.

The invention pertains also to articles like bulletproof vests and armor plates made of the above-mentioned woven fabric according to methods known to the skilled man.

The invention is further illustrated with the following example.

A construction was made containing 22 double layers. The first layer of each double layer was produced from TWARON® 930 dtex in warp (9.5 threads/cm) and polyester 140 dtex (TREVIRA® 710, ex Hoechst) in weft direction (2 threads/cm). The second layer of each double layer was produced from polyester 140 dtex (TREVIRA® 710, ex Hoechst) in warp direction (4 threads/cm) and TWARON® 930 dtex in weft direction (9.5 threads/cm). The warp/weft ratio of the first layer and the weftlwarp ratio of the second layer was 6.6:1. The layers were laminated together with 3 plies of a polyethylene film (LDPE, ex EKB) having a thickness of 10μ, one sheet of polyethylene film being placed on both outer sides of the double layer and one sheet of polyethylene film being placed in-between each of the two fabric layers of the double layer. The construction just described was placed in a press and pressed at a temperature of 120° C. and a pressure of 25 bar during 25 minutes. Then, the heating of the press was switched off. The total weight of the construction was about 4600 g/m$^2$.

V50 values were determined with 9×19 Para Type DM 11 A1B2 bullets, wherein V 50 is the velocity at which 50% of the bullets are stopped and 50% of the bullets give full penetration. It was found, that V 50 of this construction was 507 m/s.

The invention claimed is:

1. A penetration-resistant material comprising at least a double layer of woven fabric, wherein the double layer comprises:

a first layer of fabric composed of:

a first set of threads comprising 3.5 to 20 threads/cm, having a linear density of at least 210 dtex, and at least 65% of the fabric weight, and a second set of threads comprising 0.5 to 16 threads/cm and having a linear density of at least 50 dtex, with the second set of threads being transverse to the first set of threads, and the ratio of the number of threads/cm of the first set to that of the second set is greater than 1:1; and a second layer of fabric composed of:

a first set of threads comprising 0.5 to 16 threads/cm and having a linear density of at least 50 dtex; and a second set of threads comprising 3.5 to 20 threads/cm, having a linear density of at least 210 dtex, and comprising at least 65% of the fabric weight, with the second set of threads being transverse to the first set of threads, and the ratio of the number of threads/cm of the second set to that of the first set is greater than 1:1, and wherein the first and second sets of threads of the first layer have a parallel orientation towards the first and second sets, respectively, of threads of the second layer.

2. The penetration-resistant material of claim 1 wherein a ratio of the linear density of the first set of threads to the linear density of the second set of threads of the first layer is greater than 1:1 and wherein a ratio of the linear density of the second set of threads to the linear density of the first set of threads of the second layer is greater than 1:1.

3. The penetration-resistant material of claim 1 wherein a ratio of the linear density of the first set of threads to the linear density of the second set of threads of the first layer is greater than 4.2:1 and wherein a ratio of the linear density of the second set of threads to the linear density of the first set of threads of the second layer is greater than 4.2:1.

4. The penetration-resistant material of claim 1 wherein a ratio of the linear density of the first set of threads to the linear density of the second set of threads of the first layer is greater than 5.9:1 and wherein a ratio of the linear density of the second set of threads to the linear density of the set of threads of the second layer is greater than 5.9:1.

5. The penetration-resistant material of claim 1 wherein at least one of the second set of threads of the first layer and the first set of threads of the second layer comprises 0.5 to 8 threads/cm.

6. The penetration-resistant material of claim 1 wherein the threads of the layers of the double layer are bonded together.

7. The penetration-resistant material of claim 1 wherein the first set of threads of the first layer and the second set of threads of the second layer consist of high tenacity threads selected from the group consisting of aramide, polyethylene, and poly-p-phenylenebenzobisoxazole (PBO).

8. The penetration-resistant material of claim 1 wherein the second set of threads of the first layer and the first set of threads of the second layer are selected from the group consisting of polyester, polyethylene, polypropylene, and arymide yarn.

9. The penetration-resistant material of claim 1 wherein the first set of threads of the first layer and the second set of threads of the second layer consist of aramide threads, and the second set of threads of the first layer and the first set of threads of the second layer consist of polyester threads.

10. The penetration resistant material of claim 1 wherein the linear density of the first set of threads of the first layer and of the second set of threads of the second layer is 210 to 6720 dtex.

11. The penetration-resistant material of claim 1 wherein the linear density of the second set of threads of the first layer and of the first set of threads of the second layer is 50 to 280 dtex.

12. The penetration-resistant material of claim 1 wherein the first set of threads of the first layer and the first set of threads of the second layer are warp threads and the second set of threads of the first layer and the second set of threads of the second layer are weft threads.

13. The penetration-resistant material of claim 1 wherein at least one of the outer sides of the double layer is provided with a protective layer.

14. An article composed of the penetration-resistant material of claim 1.

15. The penetration-resistant material of claim 6 wherein the threads of the layers of the double layer are bonded together with an adhesive material.

16. The penetration resistant material of claim 1 wherein the linear density of the first set of threads of the first layer and of the second set of threads of the second layer is 420 to 3360 dtex.

17. The penetration resistant material of claim 1 wherein the linear density of the first set of threads of the first layer and of the second set of threads of the second layer is 420 to 1680 dtex.

18. The penetration resistant material of claim 1 wherein the linear density of the first set of threads of the first layer and of the second set of threads of the second layer is 840 to 1100 dtex.

19. The penetration-resistant material of claim 1 wherein the linear density of the second set of threads of the first layer and of the first set of threads of the second layer is 80 to 140 dtex.

* * * * *

UNITED STATES PATENT AND TRADEMARK OFFICE

CERTIFICATE OF CORRECTION

PATENT NO. : 7,132,380 B2
APPLICATION NO. : 10/471089
DATED : November 7, 2006
INVENTOR(S) : Christian Bottger et al.

It is certified that error appears in the above-identified patent and that said Letters Patent is hereby corrected as shown below:

On Title Page, Item (57)

Line 6,
change "50dtex" to --50 dtex;--.

Line 12,
change "first set" to --first set,--.

Column 2, Line 44,
change "wefi" to --weft--.

Column 4, Line 21,
change "weftlwarp" to --weft/warp--.

Column 4, Line 29,
change "120°C." to --120°C--.

Column 4, Line 31,
change "$g/m^{2.}$" to --$g/m^2$.--.

Signed and Sealed this

Thirtieth Day of January, 2007

JON W. DUDAS
*Director of the United States Patent and Trademark Office*